United States Patent [19]

Deurloo

[11] Patent Number: 4,799,903

[45] Date of Patent: Jan. 24, 1989

[54] ELECTRICAL CONNECTOR WITH SAFETY PARTITION

[75] Inventor: Johannis M. Deurloo, Emmen, Netherlands

[73] Assignee: N.K.F. Groep B.V., Rijswijk, Netherlands

[21] Appl. No.: 593,180

[22] Filed: Mar. 26, 1984

Related U.S. Application Data

[63] Continuation of Ser. No. 321,846, Nov. 16, 1981, abandoned.

[51] Int. Cl.[4] ..... H01R 13/15

[52] U.S. Cl. ..... 439/696; 439/459; 439/731

[58] Field of Search ..... 339/105, 107, 196 R, 339/196 M, 206–208, 210

[56] References Cited

U.S. PATENT DOCUMENTS 2,954,544 9/1960 Focosi ..... 339/196 R

*Primary Examiner*—David Pirlot

*Attorney, Agent, or Firm*—Robert J. Kraus

[57] ABSTRACT

A connector plug for permanent connection to a plurality of conductors each having a bundle of wire strands. The plug includes a housing formed by complementary insulating shells which abut each other at their edges. Contact members secured in the shells each include a connection portion for connection within the housing to a respective one of the conductors at an end portion from which insulation has been removed over a predefined length to expose the wire strands. An insulating partition is disposed between each connection portion and the abutting edges of the shells to prevent any wire strands remaining loose after connection from projecting from the housing.

2 Claims, 1 Drawing Sheet

ELECTRICAL CONNECTOR WITH SAFETY PARTITION

This is a continuation of application Ser. No. 321,846 filed Nov. 16, 1981 now abandoned.

BACKGROUND OF THE INVENTION

The invention relates to an electrical connector for permanent connection, each comprising a bundle of strands of electrically conductive material surrounded by an insulating sheath. The connector comprises a housing including complementary shells of an electrically insulating material which abut one another at their edges and in which there are secured at least two contact members. Each contact member comprises a connection portion to which there is connected an end portion of one of the conductors from which the insulating sheath has been removed over a given distance.

A connector plug of this kind is known, for example, from Netherlands patent application No. 74 09 034 (PHK 110) laid open to public inspection, corresponding to U.S. Pat. No. 3,981,555.

Notably in the case of automatic assembly, it happens that one or more strands of the conductor are not secured to the connection portion during the connection of the conductors to the contact members. Such a loose strand is liable to become situated between the edges of the shells during assembly, so that it can be touched from outside the connector plug.

SUMMARY OF THE INVENTION

It is an object of the invention to provide a connector in which this risk has been eliminated.

To this end, the connector in accordance with the invention is characterized in that between the connection portion of at least one contact member and the abutting edges of the shells there is disposed an insulating partition which is so dimensioned that the shortest path from the connection portion to the shell edges over the edge of the partition is longer than the length of the end portion of the conductor from which the insulation has been removed.

The length of any loose strands which have not been connected to the connection portion and which project from the insulating sheath, of course, equals the length of the end portion of the conductor from which the insulation has been removed. Because of the partition, the loose strands cannot reach as far as the nearest part of the shell edges.

A very simple and inexpensive embodiment of the connector in accordance with the invention is characterized in that the partitions are integral with one of the shells.

BRIEF DESCRIPTION OF THE DRAWING

The invention will be described in detail hereinafter with reference to the accompanying drawing in which.

DESCRIPTION OF THE PREFERRED EMBODIMENT

Figure 1:
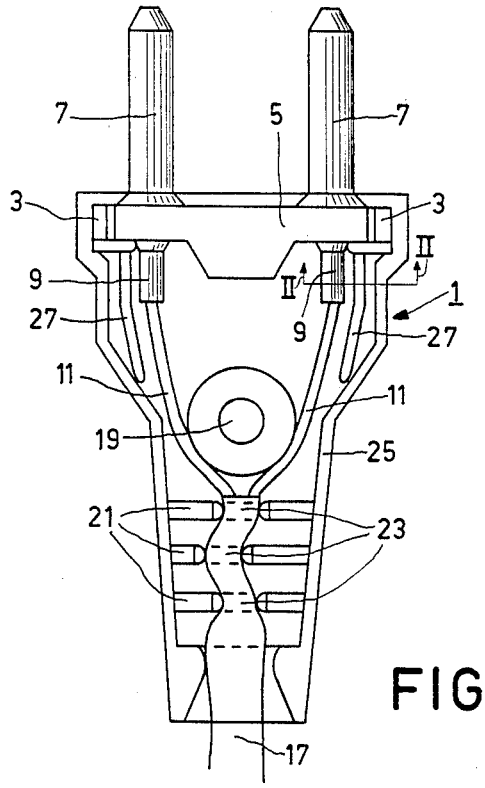
FIG. 1 is a plan view of a shell of an embodiment of a connector plug in accordance with the invention.
Figure 2:
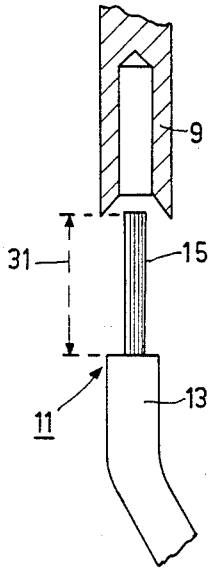
FIG. 2 is a detailed view on an enlarged scale of a part of a conductor and a connection portion of a contact member.

In a plastic shell 1 shown in FIG. 1, adjacent an edge 25, there are provided two grooves 3 for receiving an insulating bridge 5 which carries two pin-shaped contact members 7, each of which comprises a socket-like connection portion 9. Two conductors 11 of a cable 17 are connected to these connection portions. As is shown in FIG. 2, the insulating sheath 13 of each conductor 11 has been removed from the end portion of the conductor to expose the end portion of the bundle 15 of electrically conductive strands (for example, copper wires) which forms the interior of the conductor. The end portion of the bundle 15 is subsequently inserted into the respective socket-like connection portion 9, in which it is secured, for example, by crimping the connection portion or by soldering.

The shell 1 (FIG. 1) also comprises a plastic pin 19 which is inserted through an opening (not shown) in the second shell 20 (see FIG. 3) during assembly, after which the two shells are riveted together by deformation of the end of the pin. For strain relief of the cable 17, the shell 1 comprises three partitions 21 which are arranged one behind the other and which have a height such that they reach as far as the bottom of the second shell 20. Each partition includes a recess 23 which opens out of its free edge, as described in detail in the Netherlands patent application No. 74 09 034 laid open to public inspection.

Insulating partitions 27 are disposed between the connection portions 9 of the contact members 7 and the edges 25 of the shells 1 and 20. The dimensions of these partitions are such that the shortest path 29 from each connection portion 9 to the shell edges 25 over the edge of the respective partition is longer than the length 31 of the end portion of the respective conductor 11 from which the insulation has been removed. Consequently, a loose strand of the bundle 15 cannot reach the edges 25 and therefore cannot project from between these edges.

Figure 3:
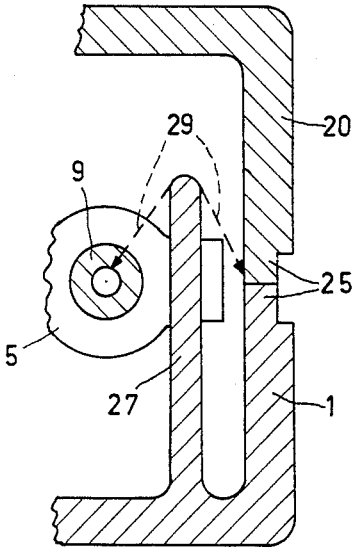
FIG. 3 is a cross-sectional view, again on an enlarged scale, and taken along the line II—II in FIG. 1, after assembly with another shell.

In the embodiment shown, the partition 27 is integral with the first shell 1 (see FIG. 3). This is a particularly attractive embodiment, because the partition can then be formed during injection moulding of the shell 1, without additional components or operations being required. Moreover, the material of the shells is comparatively inexpensive. However, it is alternatively possible to form the partitions 27 in a different manner, for example, as loose walls which are arranged in a shell or which are formed on the bridge 5. If desirable, an additional partition 27 may be provided in the upper shell 20; the additional partition must then be shifted slightly to the left or to the right with respect to the partition in the lower shell 1, so that the two partitions overlap in the vicinity of the shell edges 25. If desired, these two partitions can also be interconnected by means of adhesive or by fusion.

The shells 1, 20 of the connector plug can obviously be interconnected in a manner other than by means of the pin 19, for example, by adhesive or by screws. Alternatively, instead of pin-shaped contact members 7 other members such as socket contact members, can be used. If desired, the connector plug may also comprise earth contacts. It will be obvious that the provision of partitions 27 in accordance with the invention near the connection portions of these earth contacts is less important, because touching of the strands connected thereto is not dangerous.

What is claimed is:

1. An electrical connector for making permanent electrical connection to one end of an insulated stranded conductor from which insulating material is removed to expose a predefined length of the conductor strands, said connector including:

(a) a housing for fully enclosing the exposed conductor strands, said housing comprising complementary insulating shells abutting each other at edges thereof;

(b) a contact member extending through an opening in a wall of the housing and having a connection portion, enclosed by the housing, including an open end for receiving the exposed conductor strands, said open end being disposed in proximity to the abutting edges of the insulating shells; and (c) an insulating partition secured within the housing and establishing a barrier for preventing any exposed conductor strands not received within the contact member from extending between the abutting edges of the insulating shells, said insulating partition being disposed between the connection portion of the contact member and said abutting edges of the insulating shells, the insulating partition extending transversely of the abutting edges and being dimensioned such that the shortest distance from the open end of the connection portion around said partition to the abutting edges is longer than the predefined lengths of the exposed conductor strands.

2. An electrical connector as in claim 1 where the insulating partition comprises an integral part of one of the complementary insulating shells and extends from an inner wall of said shell.

* * * * *